US009254647B2

(12) United States Patent
Hasegawa et al.

(10) Patent No.: US 9,254,647 B2
(45) Date of Patent: Feb. 9, 2016

(54) LIQUID DISCHARGING APPARATUS AND LIQUID DISCHARGE METHOD

(71) Applicant: SEIKO EPSON CORPORATION, Tokyo (JP)

(72) Inventors: Tomonaga Hasegawa, Matsumoto (JP); Kohei Utsunomiya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/694,833

(22) Filed: Apr. 23, 2015

(65) Prior Publication Data

US 2015/0306872 A1 Oct. 29, 2015

(30) Foreign Application Priority Data

Apr. 24, 2014 (JP) ..... 2014-089887
Jan. 9, 2015 (JP) ..... 2015-002930

(51) Int. Cl.
*B41J 2/07* (2006.01)

(52) U.S. Cl.
CPC ..... *B41J 2/07* (2013.01)

(58) Field of Classification Search
CPC ..... B41J 2/07; B41J 2/04516
USPC ..... 347/12
See application file for complete search history.

(56) References Cited

U.S. PATENT DOCUMENTS 7,850,270 B2 * 12/2010 Nitta ..... B41J 2/2139 347/14
8,622,502 B2 * 1/2014 Mizutani ..... B41J 2/2128 347/15
2004/0021731 A1 2/2004 Yabe et al.
2005/0122377 A1 6/2005 Mizutani et al.
2006/0012631 A1 * 1/2006 Niekawa ..... B41J 2/145 347/41
2009/0153606 A1 6/2009 Mizutani et al.

FOREIGN PATENT DOCUMENTS

JP 2004-001491 1/2004
JP 2005-186610 7/2005
JP 2005-280273 10/2005
JP 2009-160930 7/2009
JP 2011-126110 6/2011

* cited by examiner

*Primary Examiner* — Justin Seo
*Assistant Examiner* — Michael Konczal
(74) *Attorney, Agent, or Firm* — Workman Nydegger

(57) ABSTRACT

A liquid discharging apparatus includes: a liquid discharge head including plural nozzle rows each arrayed with plural nozzles and discharging liquid droplets onto a workpiece by a multi-pass method using n recording passes (n is an integer of 3 or more); and a head drive section that controls driving of n nozzle groups corresponding to the n recording passes in each of the nozzle rows with a discharge duty upper limit specific to each nozzle group, and for a pair of nozzle groups adjacent across the nozzle rows, when controlling driving of one of the nozzle groups with a discharge duty upper limit being the maximum discharge duty upper limit of one nozzle row containing the one nozzle group, controls driving of the other nozzle group with a discharge duty upper limit that is not the maximum discharge duty upper limit of another nozzle row containing the other nozzle group.

6 Claims, 6 Drawing Sheets

LIQUID DISCHARGING APPARATUS AND LIQUID DISCHARGE METHOD

BACKGROUND

1. Technical Field

The present invention relates to a liquid discharging apparatus that discharges a liquid onto a workpiece, and to a liquid discharge method thereof.

2. Related Art

Hitherto, an ink jet recording apparatus (liquid discharging apparatus) that includes a recording head and a recording controller is known. The recording head includes plural ejection orifice (discharge opening) groups that are each arrayed with plural ejection orifices that eject ink onto a recording medium by a double pass method using two recoding passes. The recording controller controls, out of two groups in each ejection orifice group that correspond to the two recording passes, driving of one group with a different recording ratio (thinning ratio) to another group, and, when controlling driving of one group with a high recording ratio from two groups adjacent across the ejection orifice groups, controls the driving of the other group with a low recording ratio. Such an ink jet recording apparatus suppresses generation of an air current from the recording medium toward the ejection orifice face during ejection by avoiding driving of two groups that are adjacent to each other across the ejection orifice groups with a high ejection duty at the same time as each other, thereby suppressing adhesion of ink mist to the ejection orifice face (see JP-A-2005-186610).

However, there has been no consideration hitherto in ink jet recording apparatuses of dividing each of the ejection orifice groups into three or more groups, and controlling driving of the three or more groups.

SUMMARY

An advantage of some aspects of the invention is that a liquid discharging apparatus and liquid discharge method that are capable of suppressing adhesion of ink mist to a nozzle face are provided.

A liquid discharging apparatus according to an aspect of the invention includes: a liquid discharge head that includes plural nozzle rows each arrayed with plural nozzles, and that discharges liquid droplets onto a workpiece by a multi-pass method using n recording passes, where n is an integer of 3 or more; and a head drive section that controls driving of n nozzle groups corresponding to the n recording passes in each of the nozzle rows within a range of a discharge duty upper limit specific to each nozzle group, and for a pair of nozzle groups adjacent across the nozzle rows, when controlling driving of one of the nozzle groups within a range of a first discharge duty upper limit that is the maximum discharge duty upper limit of one nozzle row containing the one nozzle group, controls driving of the other nozzle group within a range of a second discharge duty upper limit that is not the maximum discharge duty upper limit of another nozzle row containing the other nozzle group.

A liquid discharge method according to an aspect of the invention is for a liquid discharging apparatus including a liquid discharge head that includes plural nozzle rows each arrayed with plural nozzles, and that discharges liquid droplets onto a workpiece by a multi-pass method using n recording passes, where n is an integer of 3 or more. The liquid discharge method includes: when driving n nozzle groups corresponding to the n recording passes in each of the nozzle rows within a range of a discharge duty upper limit specific to each nozzle group, and for a pair of nozzle groups adjacent across the nozzle rows, when driving one of the nozzle groups within a range of a first discharge duty upper limit that is the maximum discharge duty upper limit of one nozzle row containing the one nozzle group, driving the other nozzle group within a range of a second discharge duty upper limit that is not the maximum discharge duty upper limit of another nozzle row containing the other nozzle group.

According to such a configuration, three or more nozzle groups in each of the nozzle rows are driven within a range of a discharge duty upper limit specific to the nozzle group. For a pair of nozzle groups adjacent in the nozzle row direction, when driving one of the nozzle groups within a range of a first discharge duty upper limit that is the maximum discharge duty upper limit of the one nozzle row, driving the other nozzle group within a range of a second discharge duty upper limit that is not the maximum discharge duty upper limit of the other nozzle row. Thereby, driving of a pair of nozzle groups that are adjacent to each other across the nozzle rows with a high discharge duty at the same time is suppressed. Thus, generation of an air current from the workpiece toward the nozzle face during discharge can be suppressed between the two nozzle groups adjacent across the nozzle rows. This thereby enables adhesion of ink mist to the nozzle face to be suppressed.

In the above liquid discharging apparatus, preferably the second discharge duty upper limit is less than the first discharge duty upper limit.

According to such a configuration, for a pair of nozzle groups adjacent in the nozzle row direction, when driving one of the nozzle groups within a range of the maximum discharge duty upper limit in the one nozzle row, the other nozzle group is driven within a range that is less than the maximum discharge duty upper limit in the one nozzle row. Accordingly, nozzle groups with the maximum discharge duty upper limit of their respective nozzle rows are not adjacent to each other, enabling generation of an air current from the recording medium toward the nozzle face during discharge to be suppressed. This thereby enables adhesion of ink mist to the nozzle face to be suppressed.

The second discharge duty upper limit is preferably the minimum discharge duty upper limit in the other nozzle row containing the other nozzle group.

According to such a configuration, for a pair of nozzle groups adjacent in the nozzle row direction, when driving one of the nozzle groups within a range of the maximum discharge duty upper limit in the one nozzle row, the other nozzle group is driven within a range that is the minimum discharge duty upper limit in the other nozzle row. Accordingly, generation of an air current from the workpiece toward the nozzle face during discharge can be further suppressed between the pair of nozzle groups adjacent across the nozzle rows. This thereby enables adhesion of ink mist to the nozzle face to be effectively suppressed.

In this case, out of the n nozzle groups contained in one nozzle row for a pair of adjacent nozzle rows, preferably the head drive section controls driving of plural first nozzle groups that are positioned on one side in the nozzle row direction in which the plural nozzles are arrayed within a range of respective discharge duty upper limits that are not 0%, and controls driving of plural nozzle groups that are positioned on the other side in the nozzle row direction with a discharge duty upper limit of 0%, and out of the n nozzle groups contained in the other nozzle row, controls driving of plural nozzle groups that are positioned at the one side in the nozzle row direction with a discharge duty upper limit that is 0%, and controls driving of plural second nozzle groups that are positioned on the other side in the nozzle row direction within a range of respective discharge duty upper limits that are not 0%.

According to such a configuration, out of the n nozzle groups contained in the one nozzle row for the pair of adjacent nozzle rows, the plural nozzle groups positioned at one side in the nozzle row direction are driven within a range of respective discharge duty upper limits that are not 0%. Moreover, since, out of the n nozzle groups contained in the other nozzle row, the plural nozzle groups positioned on the one side in the nozzle row direction are driven with a discharge duty upper limit of 0%, no ink is discharged. Similarly since, out of the n nozzle groups contained in the one nozzle row, plural nozzle groups that are positioned at the other side in the nozzle row direction are driven with a discharge duty upper limit that is 0%, no ink is discharged. Moreover, out of the n nozzle groups contained in the other nozzle row, plural nozzle groups that are positioned at the other side in the nozzle row direction are driven within a range of respective discharge duty upper limits that are not 0%. Thus, in the pair of nozzle groups adjacent across the nozzle rows, a state is achieved in which ink is discharged from one of the pair of nozzle groups, and ink is not discharged from the other of the pair of nozzle groups. This thereby enables generation of an air current from the workpiece toward the nozzle face during discharge to be further suppressed between the pair of nozzle groups adjacent across the nozzle rows. This thereby enables adhesion of ink mist to the nozzle face to be effectively suppressed.

In this case, out of the plural first nozzle groups, preferably the head drive section controls driving of the nozzle group that is positioned furthest to the other direction side in the nozzle row direction within a range of a discharge duty upper limit that is the minimum discharge duty upper limit of the plural first nozzle groups, and, out of the plural second nozzle groups, controls driving of the nozzle group that is positioned furthest to the one side in the nozzle row direction within a range of discharge duty upper limit that is the minimum discharge duty upper limit of the plural second nozzle groups.

According to such a configuration, in a pair of adjacent nozzle rows, the nozzle group that is positioned nearest to the other direction side in the nozzle row direction out of plural nozzle groups in the one nozzle row that are controlled so as to be driven with discharge duty upper limits that are not 0% (referred to below as the "nearest nozzle group"), and a nearest nozzle group that is nearest to the one side in the nozzle row direction out of the plural nozzle groups controlled to be driven at discharge duty upper limits that are not 0% in the other nozzle row, are positioned comparatively close to each other, despite not adjacent to each other across the nozzle rows. Suppose that the nearest nozzle group in the one nozzle row were to be driven within a range of the maximum discharge duty upper limit of the one nozzle row, and the nearest nozzle group in the other nozzle row were also to be driven within the range of the maximum discharge duty upper limit of the other nozzle row, there would be a concern that an air current from the workpiece toward the nozzle face might be generated by the liquid discharge from the two nearest nozzle groups. In contrast thereto, in the present configuration, the nearest nozzle group in the one nozzle row is driven within a range of the minimum discharge duty upper limit of the plural nozzle groups controlled to be driven with discharge duty upper limits that are not 0% in the one nozzle row, and the nearest nozzle group in the other nozzle row is also driven within the range of the minimum discharge duty upper limit of the plural nozzle groups controlled to be driven with discharge duty upper limits that are not 0% in the other nozzle row. Generation of an air current from the workpiece toward the nozzle face by the liquid discharge from the two nearest nozzle groups is thereby able to be suppressed. This thereby enables adhesion of ink mist to the nozzle face to be effectively suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
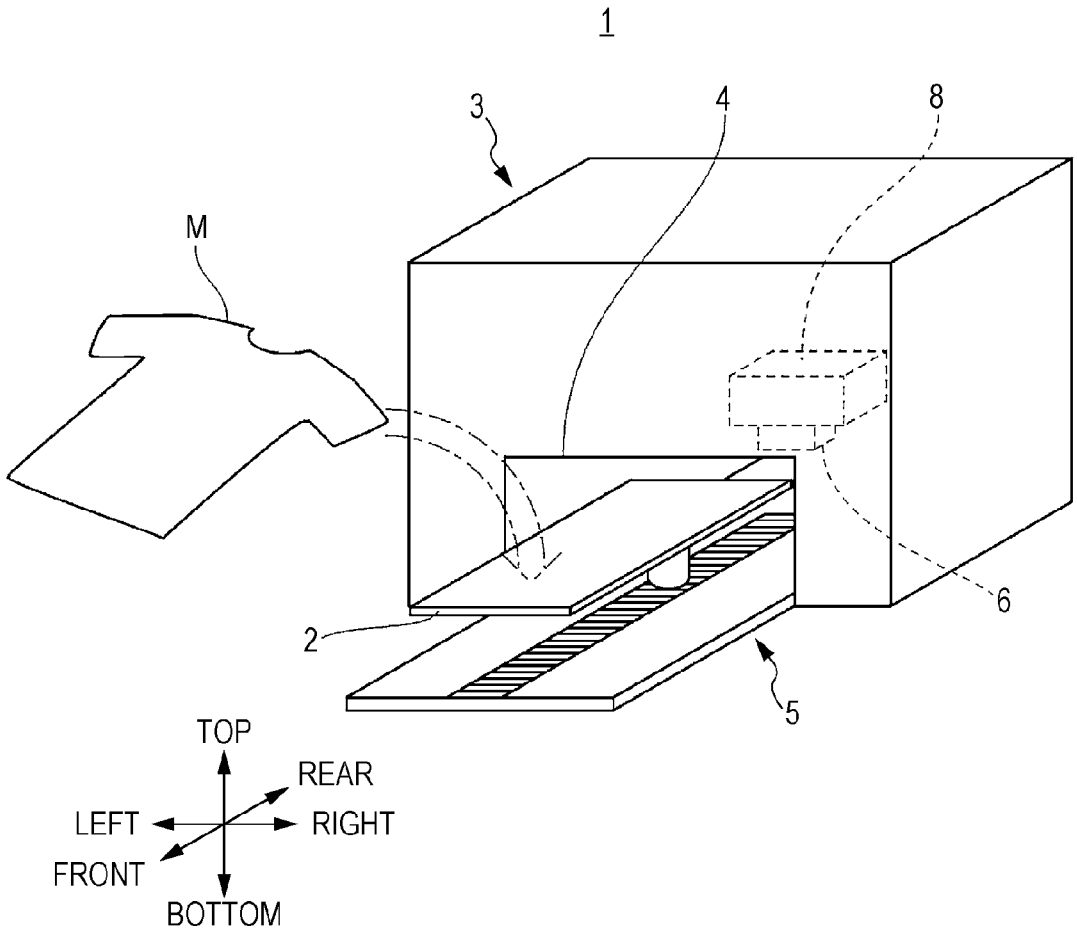
FIG. 1 a configuration diagram of a recording apparatus according to an exemplary embodiment of the invention.

Explanation follows regarding a recording apparatus according to an exemplary embodiment of the invention with reference to the appended drawings. The recording apparatus is an apparatus that records an image by discharging ink by an ink jet method onto a recording medium, such as cloth.

In the following, explanation is given with reference to "top", "bottom", "left", "right", "front", "rear" in the drawings. However, these directions are merely employed for ease of reference, and embodiments of the invention are not limited to these directions.

As illustrated in FIG. 1, a recording apparatus 1 includes a medium holder 2 that holds a recording medium M, a substantially box-shaped recording section 3 that is long in the cross-direction, and a transport section 5 that transports the medium holder 2 in the front/rear direction. Cloth, such as a T shirt or polo neck shirt, may be appropriately employed as the recording medium M, however general purpose printing paper or the like may also be employed therefor. A three dimensional object, such as a hat, may also be employed therefor.

The recording section 3 records an image on the recording medium M held on the medium holder 2. The recording section 3 includes a cartridge 8 in which a liquid discharge head 6 is installed, and a head movement mechanism 7 (see FIG. 2) that moves the liquid discharge head 6 to the left and right by moving the cartridge 8. The head movement mechanism 7 is configured by a motor-driven belt mechanism.

The transport section 5 moves the medium holder 2 between a front setup position and a rear recording start position, through an entry/exit port 4 provided in the front face of the recording section 3. The transport section 5 is configured by a motor-driven belt mechanism.

In order to record an image on the recording medium M using the recording apparatus 1, first a user sets up the recording medium M on the medium holder 2 that has been moved to the setup position. Then, on receipt by the recording apparatus 1 of an instruction to start recording, the transport section 5 moves the medium holder 2 from the setup position, through the entry/exit port 4, to the recording start position. The transport section 5 then moves the medium holder 2 forward from the recording start position at intervals in time, and the liquid discharge head 6 discharges ink onto the recording medium M setup on the passing medium holder 2 while scanning back and forth in the left-right direction. The recording apparatus 1 performs a recording operation in this manner to record an image on the recording medium M. The recording apparatus 1 is capable of performing a recording operation by a multi-pass method, as described below. The discharge of ink by the liquid discharge head 6 while scanning over the recording medium M is referred to as a "recording pass". A single recording pass indicates that the liquid discharge head 6 discharges ink while scanning over the recording medium M in one direction from out of the left-right directions, and this is sometimes referred to simply as a recording pass.

Figure 2:
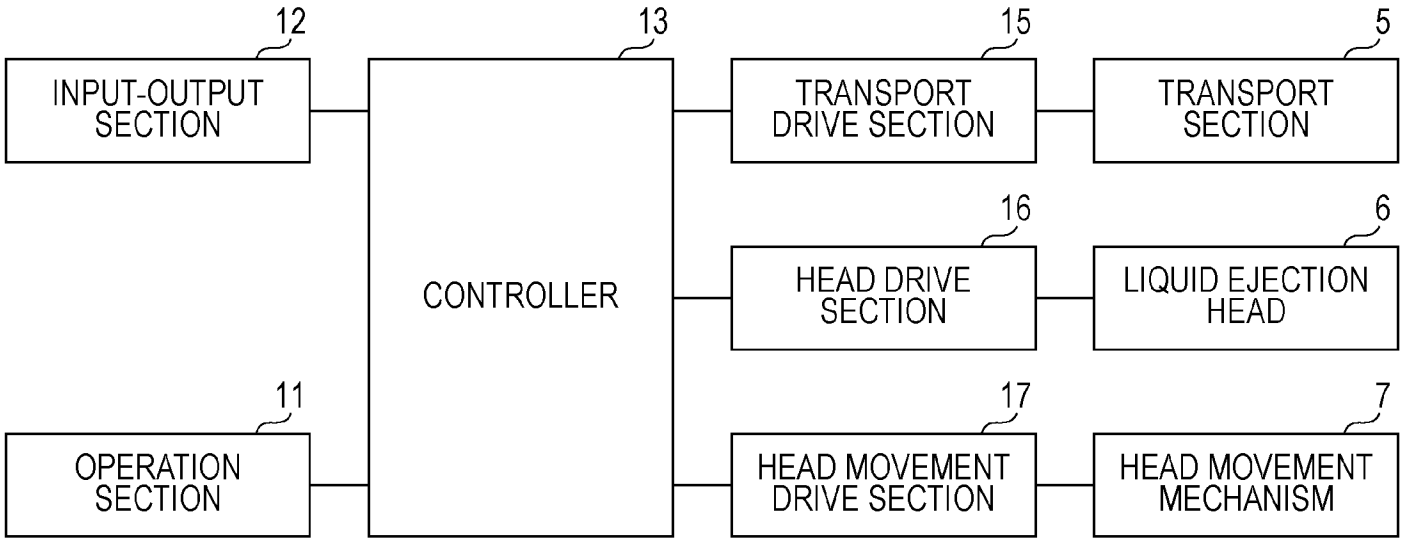
FIG. 2 is a control block diagram of a recording apparatus.

As illustrated in FIG. 2, the recording apparatus 1 includes the transport section 5, the liquid discharge head 6, the head movement mechanism 7, an operation section 11, an input-output section 12, a controller 13, a transport drive section 15, a head drive section 16, and a head movement drive section 17.

The operation section 11 is constituted by operation buttons and a liquid crystal display. The operation section 11 accepts operation by a user, and displays various pieces of information.

The input-output section 12 is connected to an external device, not illustrated in the drawings, receives various data such as image data and supplies the data to the controller 13, and transmits data supplied from the controller 13 to the external device. The external device is, for example, a data processing device, such as a personal computer, a smartphone, or a tablet. Obviously, a configuration may be adopted in which image data is supplied from various types of memory, such as a Universal Serial Bus (USB) memory, rather than through an external device.

The controller 13 is configured including a central processing unit (CPU), read only memory (ROM), random access memory (RAM), and the like, not illustrated in the drawings. The CPU of the controller 13 loads a program from the ROM, executes the program using the RAM, and controls the overall operation of the recording apparatus 1.

The transport drive section 15, the head drive section 16, and the head movement drive section 17 are configured by drive circuits. The transport drive section 15, the head drive section 16, and the head movement drive section 17, control driving of the transport section 5, the liquid discharge head 6, and the head movement mechanism 7, respectively, according to control signals from the controller 13.

Figure 3:
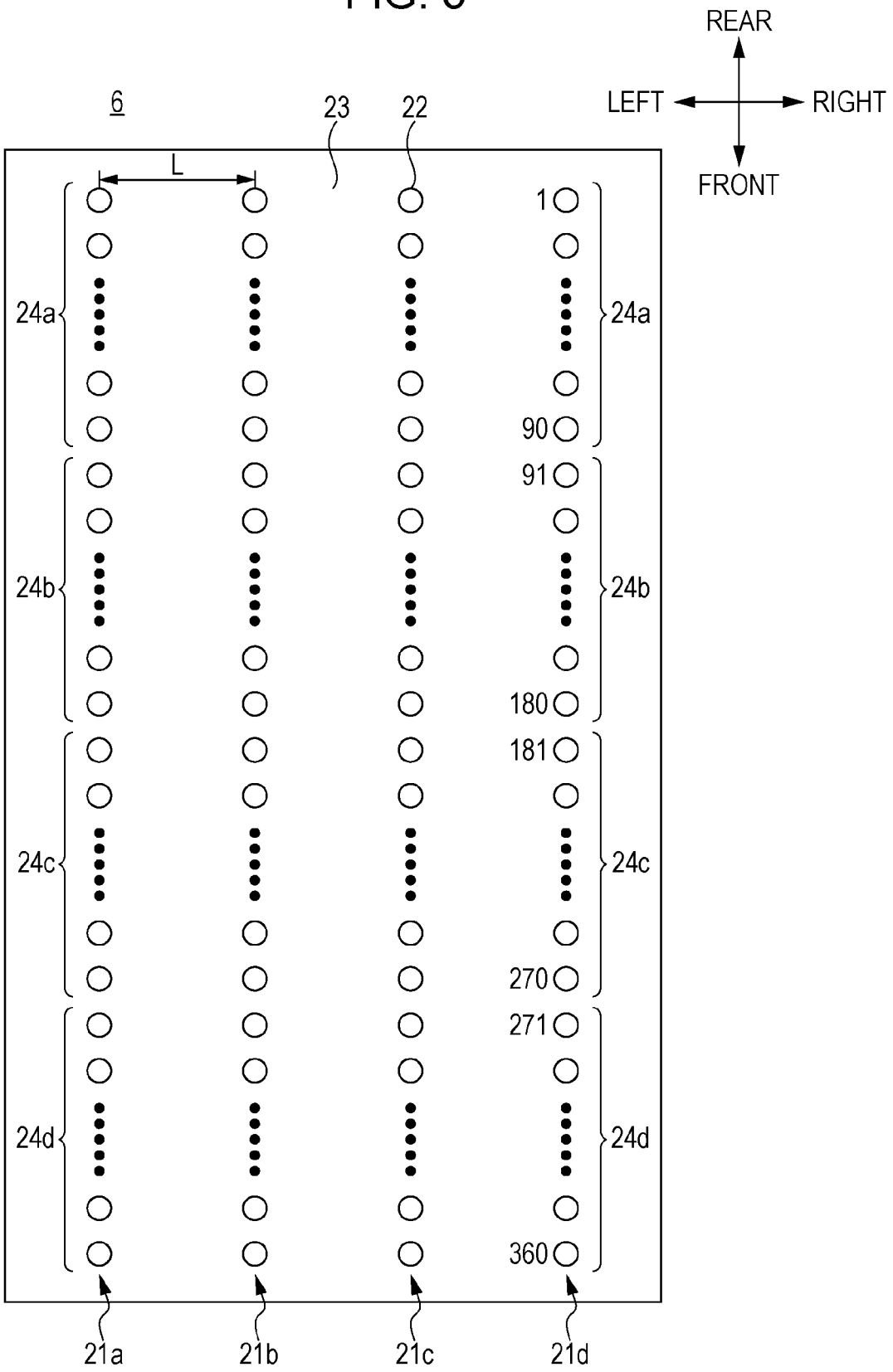
FIG. 3 is a schematic diagram of a liquid discharge head.

As illustrated in FIG. 3, the liquid discharge head 6 includes, in sequence from the left, a first nozzle row 21*a*, a second nozzle row 21*b*, a third nozzle row 21*c*, and a fourth nozzle row 21*d*. In the following, reference will simply be made to "a nozzle row 21" or "nozzle rows 21" when there is no need to discriminate between the first nozzle row 21*a* to the fourth nozzle row 21*d*.

The liquid discharge head 6 discharges ink by an ink jet method. The drive frequency of the liquid discharge head 6 is, for example, a maximum of 30 kHz. The liquid discharge head 6 discharges cyan ink from the first nozzle row 21*a*, discharges magenta ink from the second nozzle row 21*b*, discharges yellow ink from the third nozzle row 21*c*, and discharges black ink from the fourth nozzle row 21*d*. Obviously, the color of the ink discharged from each of the nozzle rows 21 is not limited to these colors. The number of the nozzle rows 21 is not limited to the above described four rows, but may be two or more nozzle rows.

The nozzle rows 21 each include 360 nozzles 22. The 360 nozzles 22 are arrayed in a row along the front-rear direction. The length of each of the nozzle rows 21 is 1 inch. Namely, the nozzle density in each of the nozzle rows 21 is 360 dots per inch (dpi). Adjacent pairs of nozzle rows 21 are provided so as to be staggered. Namely, one of the nozzle rows 21 is displaced by half a nozzle pitch with respect to the other nozzle row 21. The inter-nozzle-row distance L is approximately 12 mm.

Obviously, these numerical values are merely examples, and there is no limitation thereto.

Figure 4:
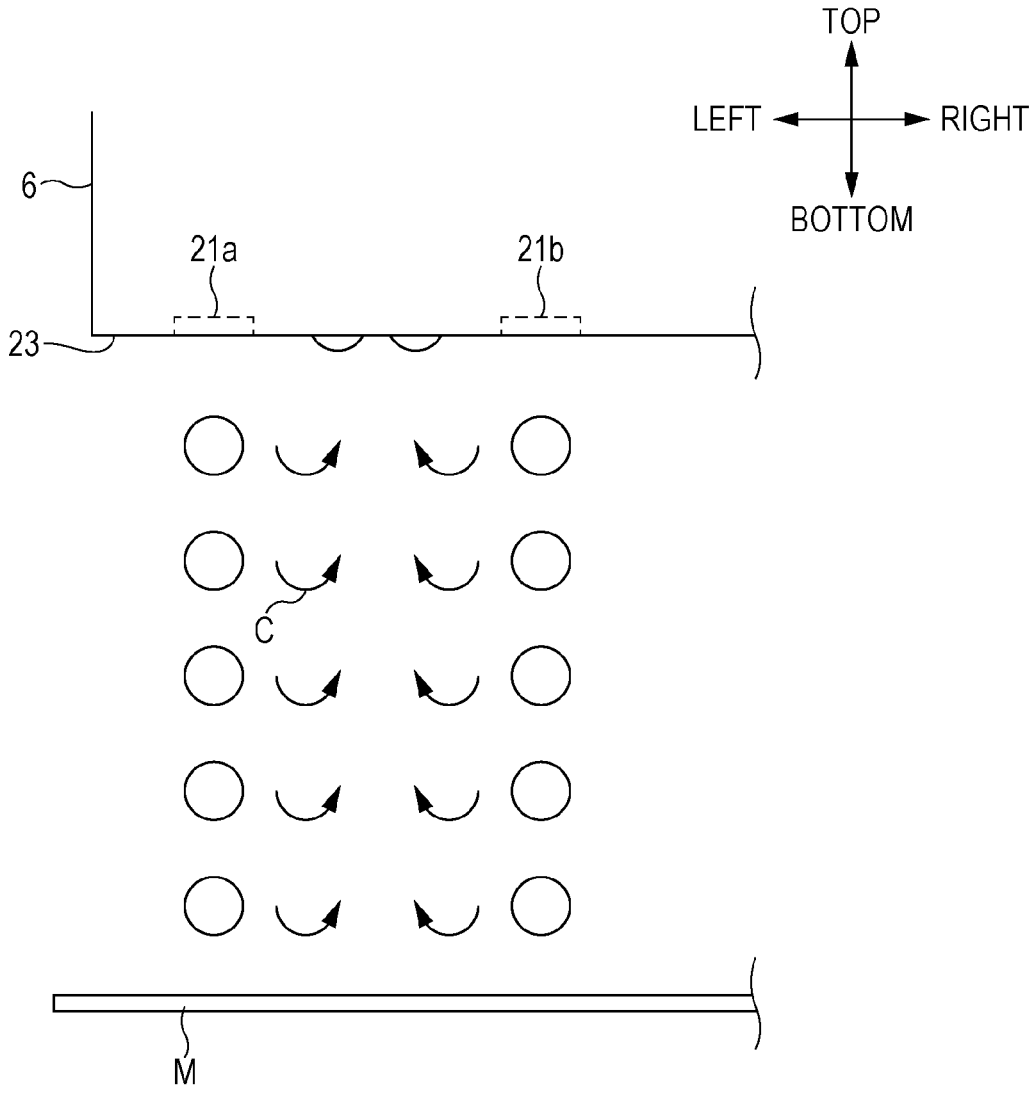
FIG. 4 is an explanatory diagram of ink mist adhering to a nozzle face when two adjacent nozzle rows are driven with a high discharge duty at the same time as each other.

As illustrated in FIG. 4, it is found from investigations up to now that when the inter-nozzle-row distance L is narrow (20 mm or less), when the nozzle density is high (300 dpi or greater), and when the drive frequency of the liquid discharge head 6 is high (30 kHz or above), if a pair of adjacent nozzle rows 21, for example the first nozzle row 21*a* and the second nozzle row 21*b*, are both driven with a high discharge duty at the same time as each other while moving the liquid discharge head 6 in the left-right direction, ink mist tends to adhere to a nozzle face 23. This is due to an air current C being generated from the recording medium M toward the nozzle face 23, and the ink mist being caught up in the air current C generated between the first nozzle row 21*a* and the second nozzle row 21*b*.

Thus in the present exemplary embodiment, control is performed to suppress adhesion of ink mist to the nozzle face 23 by a pair of nozzle groups 24 that are adjacent across nozzle rows 21 (described later) being not driven with a high discharge duty at the same time as each other. Explanation follows regarding an example of a case in which recording operation is performed by a 4 pass method.

Figure 5:
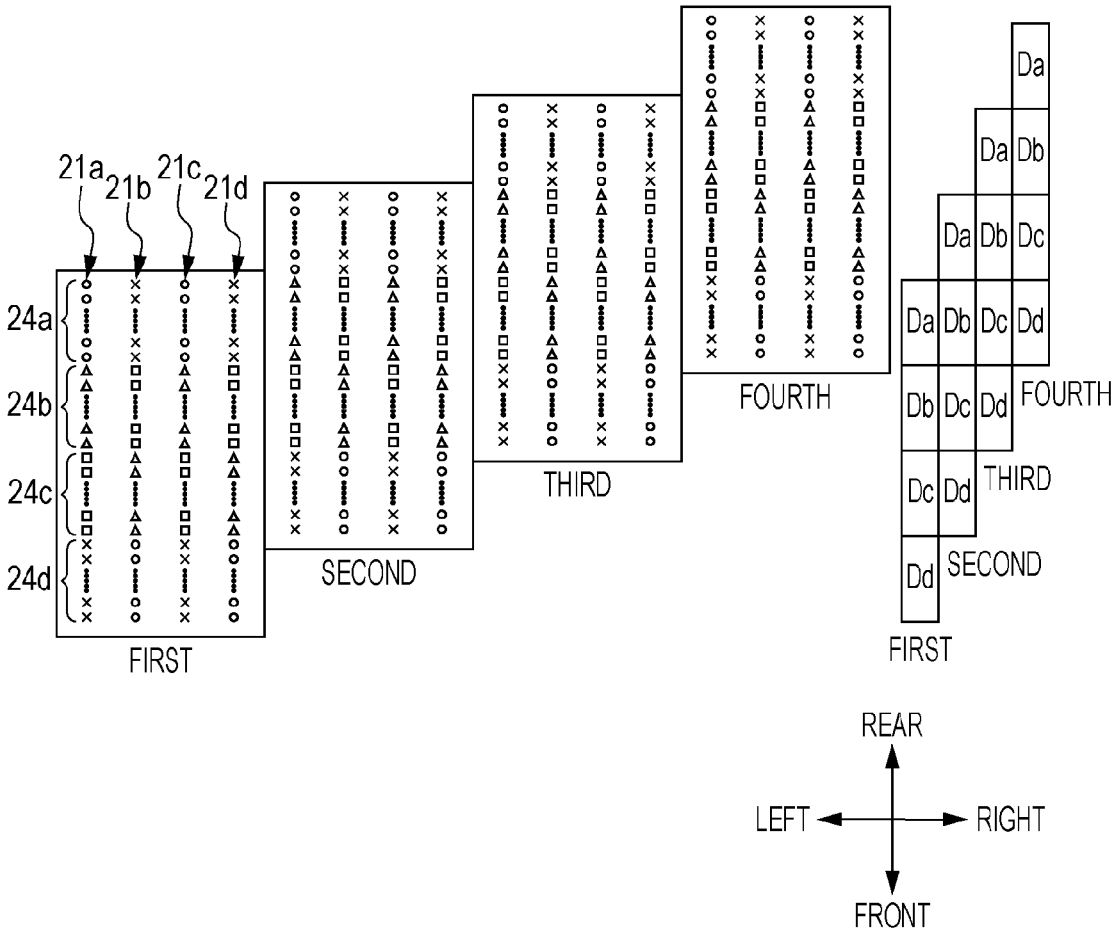
FIG. 5 is a diagram explaining a recording operation in the present exemplary embodiment.

As illustrated in FIG. 5, the recording apparatus 1 performs recording operation by moving the recording medium M with respect to the liquid discharge head 6 by ¼ the length of the nozzle rows 21 toward the front between one recording pass and another recording pass. For convenience, in FIG. 5, such movement is illustrated as movement of the liquid discharge head 6 toward the rear with respect to the recording medium M. Obviously, configuration may actually be made such that the liquid discharge head 6 is moved with respect to the recording medium M between one recording pass and another recording pass. There is no limitation to the liquid discharge head 6 moving with respect to the recording medium M each recording pass, and configuration may be made such that the recording medium M is moved with respect to the liquid discharge head 6.

The 360 nozzles 22 contained in each of the nozzle rows 21 are divided into four groups to correspond to the four recording passes, and are referred to as, in sequence from the rear, a first nozzle group 24*a*, a second nozzle group 24*b*, a third nozzle group 24*c*, and a fourth nozzle group 24*d*. In the following, reference is made simply to "a nozzle group 24" or "nozzle groups 24" when there is no need to discriminate between the first nozzle group 24*a* to fourth nozzle group 24*d*. Each nozzle group 24 is configured by 90 of the nozzles 22.

Dots formed by ink discharged from the first nozzle group 24*a* are called first dots Da. Similarly, dots formed by ink discharged from the second nozzle group 24*b* are called second dots Db, dots formed by ink discharged from the third nozzle group 24*c* are called third dots Dc, and dots formed by ink discharged from the fourth nozzle group 24*d* are called fourth dots Dd.

In FIG. 5, the first dots Da are dots formed by the respective first nozzle groups 24*a* from the first nozzle row 21*a* to fourth nozzle row 21*d*, and are each collectively represented by a single rectangular shape. Similar applies to the second dots Db to the fourth dots Dd.

In a region where the first dots Da are formed by the first nozzle group 24*a* in the first recording pass, the second dots Db are formed by the second nozzle group 24*b* in the second recording pass, the third dots Dc are formed by the third nozzle group 24*c* in the third recording pass, and the fourth dots Dd are formed by the fourth nozzle group 24*d* in the fourth recording pass.

The head drive section 16 controls driving of the four nozzle groups 24 in each of the nozzle rows 21 with a discharge duty upper limit of the nozzle group 24. The discharge duty upper limit is the upper limit value to the discharge duty. The discharge duty is the ratio of pixels formed as dots by discharge of ink in a single recording pass, to the total number of pixels, in a unit region of the recording medium M. The controller 13 generates head drive data based on, for example, the image data, and a recording mode (recording quality or the like) input from the operation section 11, such that the discharge duty upper limit of each of the nozzle groups 24 is not exceeded. The controller 13 then transmits the head drive data to the head drive section 16. The head drive section 16 controls driving of the liquid discharge head 6 based on the head drive data received.

Moreover, the head drive section 16 controls driving of the first nozzle row 21*a* and the third nozzle row 21*c* such that the respective discharge duty upper limits of the first nozzle group 24*a*, the second nozzle group 24*b*, the third nozzle group 24*c*, and the fourth nozzle group 24*d* are "100%, 75%, 50%, 25%" (referred to below as the "upper limit pattern"). The head drive section 16 controls driving of the second nozzle row 21*b* and the fourth nozzle row 21*d* such that the upper limit pattern is "25%, 50%, 75%, 100%". Namely, when the head drive section 16 controls driving of one of the nozzle groups 24 in a pair of nozzle groups 24 adjacent across the nozzle rows 21, with the maximum discharge duty upper limit for the nozzle row 21 containing that nozzle group 24, the head drive section 16 controls driving of the other nozzle group 24 in the pair of nozzle groups 24 at the minimum upper discharge duty limit for the other nozzle row 21 containing that nozzle group 24.

For convenience, in FIG. 5, nozzles 22 with a discharge duty upper limit at 100% are depicted as a white circle, nozzles 22 at 75% are depicted as a white triangle, nozzles 22 at 50% are depicted as a white square, and nozzles at 25% are depicted as a cross.

The first nozzle group 24*a* of the first nozzle row 21*a* is accordingly driven within the range of the maximum discharge duty upper limit (100%) for the first nozzle row 21*a*. The first nozzle group 24*a* of the second nozzle row 21*b* is driven within the range of the minimum discharge duty upper limit (25%) for the second nozzle row 21*b*. Similarly, the fourth nozzle group 24*d* of the second nozzle row 21*b* is driven within the range of the maximum discharge duty upper limit (100%) for the second nozzle row 21*b*. The fourth nozzle group 24*d* of the first nozzle row 21*a* is driven within the range of the minimum discharge duty upper limit (25%) for the first nozzle row 21*a*.

In this manner, in the present exemplary embodiment, driving of a pair of nozzle groups 24 adjacent across the nozzle rows 21, for example the first nozzle group 24*a* of the first nozzle row 21*a* and the first nozzle group 24*a* of the second nozzle row 21*b* with a high discharge duty at the same time as each other is suppressed. This thereby enables generation of an air current C from the recording medium M toward the nozzle face 23 to be suppressed between a pair of the nozzle groups 24 adjacent across the nozzle rows 21 during discharge. This thereby enables adhesion of ink mist to the nozzle face 23 to be suppressed.

In the present exemplary embodiment, the upper limit pattern in the first nozzle row 21*a* is "100%, 75%, 50%, 25%"; however the upper limit pattern is not limited thereto, and may, for example, be "80%, 60%, 40%, 20%". In such cases, the maximum discharge duty upper limit is 80%. Moreover, the upper limit pattern does not necessarily have to rise in sequence or fall in sequence, and may contain duplicated discharge duty upper limits, such as for example "100%, 50%, 50%, 0%" or may have duty upper limits that rise and fall, such as "75%, 25%, 100%, 50%". Moreover, various upper limit patterns may be prepared, and the upper limit pattern may be switched according to image data and recording mode.

In the present exemplary embodiment, the upper limit pattern of the first nozzle row 21*a* is "100%, 75%, 50%, 25%" and the upper limit pattern of the second nozzle row 21*b* is "25%, 50%, 75%, 100%", this being the opposite sequence to the upper limit pattern of the first nozzle row 21*a*. There is, however, no limitation thereto. Namely, it is sufficient that, for the first nozzle group 24*a* in the first nozzle row 21*a* restricted to the maximum discharge duty upper limit (100%), the discharge duty upper limit of the first nozzle group 24*a* of the second nozzle row 21*b* adjacent across the nozzle rows 21 is not also the maximum for the second nozzle row 21*b*. For example, in a case in which the upper limit pattern of the first nozzle row 21*a* is "100%, 75%, 50%, 25%", the upper limit pattern of the second nozzle row 21*b* may have a different sequence, such as "50%, 25%, 75%, 100%", or may have different values, such as "20%, 40%, 60%, 80%". There is no need for the upper limit pattern of the first nozzle row 21*a* to be the same as the upper limit pattern of the third nozzle row 21*c*. When the first nozzle group 24*a* of the first nozzle row 21*a* has the maximum discharge duty upper limit, the discharge duty upper limit of the first nozzle group 24*a* of the second nozzle row 21*b* adjacent across the nozzle rows 21 is preferably less than the maximum discharge duty upper limit of the first nozzle row 21*a*. Moreover, even in a case in which the maximum discharge duty upper limit of the one nozzle row is 100% and the maximum discharge duty upper limit of the other nozzle row is 80%, such as when the upper limit pattern of one nozzle row is "100%, 75%, 50%, 25%" and the upper limit pattern of another nozzle row is "20%, 40%, 60%, 80%", it is preferable that the positional relationship is such that nozzle groups with the maximum discharge duty upper limits of the respective nozzle rows are not adjacent to each other. Although any air current C generated toward the nozzle face 23 would be smaller than in a case in which the maximum discharge duty upper limit of the respective nozzle rows is 100%, generation of air current is further suppressed by adopting a positional relationship such that nozzle groups with the maximum discharge duty upper limits for the respective nozzle rows are not next to each other in adjacent nozzle rows.

Explanation has been given in the present exemplary embodiment of a case of a 4 pass method, in which the number of recording passes is four. However there is no limitation thereto, and the invention is applicable to cases in which the number of recording passes is three or more. In a case of an 8 pass method in which the number of recording passes is eight, the upper limit pattern of the first nozzle row 21*a* may, for example, be "100%, 90%, 80%, 70%, 60%, 50%, 40%, 30%", and the upper limit pattern of the second nozzle row 21*b* may be "30%, 40%, 50%, 60%, 70%, 80%, 90%, 100%".

Figure 6:
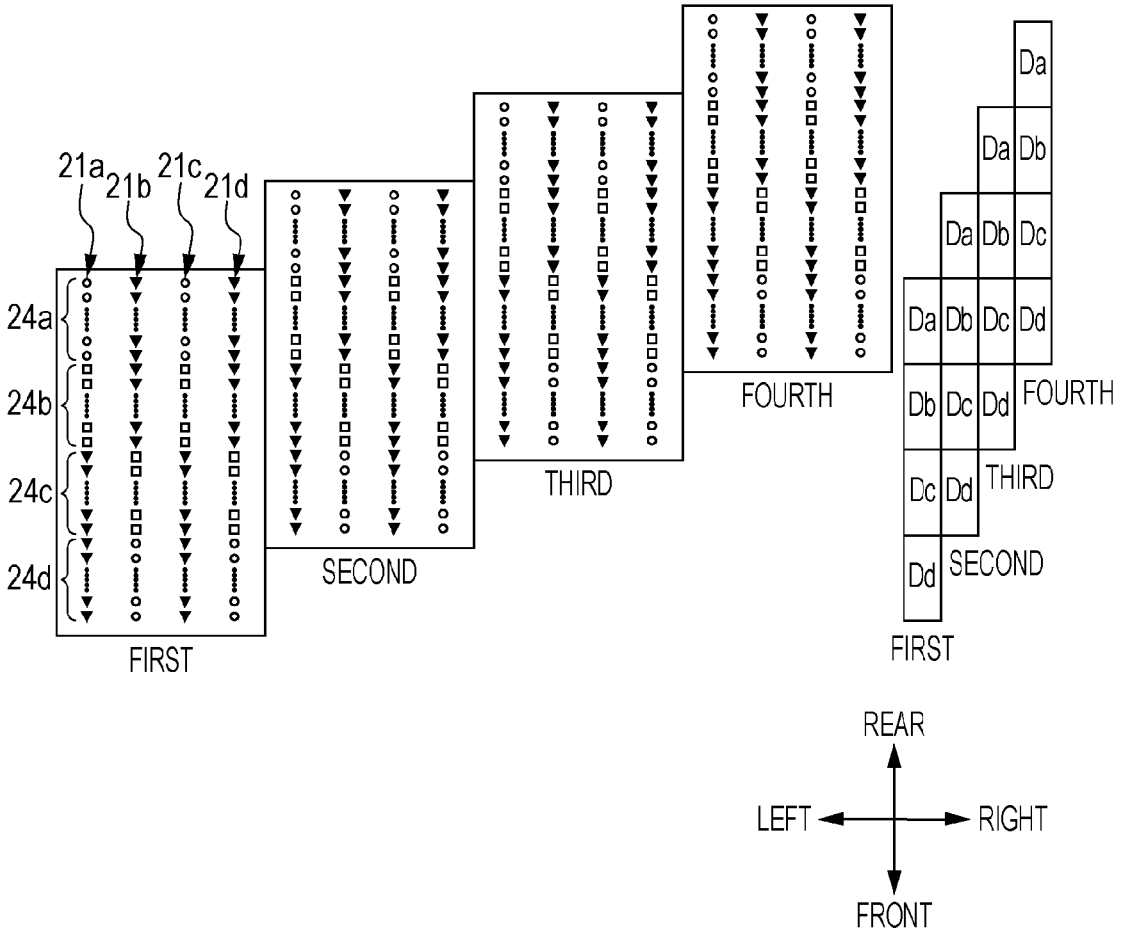
FIG. 6 is a diagram explaining a recording operation in a modified example of the present exemplary embodiment.

Explanation follows regarding a modified example of the present exemplary embodiment, with reference to FIG. 6. A recording apparatus 1 according to the modified example is configured substantially the same as the recording apparatus 1 described above, however it differs in the upper limit pattern in each of the nozzle rows 21. Explanation next follows focusing on the differences. Unless stated otherwise, the explanation given for the recording apparatus 1 above also applies to the recording apparatus 1 of the modified example.

In the recording apparatus 1 of the modified example, the head drive section 16 controls driving such that the upper limit pattern for a first nozzle row 21*a* and a third nozzle row 21*c* is "100%, 50%, 0%, 0%", and controls driving such that the upper limit pattern for a second nozzle row 21*b* and a fourth nozzle row 21*d* is "0%, 0%, 50%, 100%". In FIG. 6, nozzles 22 with a discharge duty upper limit at 100% are depicted as a white circle, nozzles 22 at 50% are depicted as a white square, and nozzles at 25% are depicted as an inverted black triangle.

In other words, the head drive section 16 controls driving such that in adjacent pairs of nozzle rows 21, for example in the first nozzle row 21*a* and the second nozzle row 21*b*, out of the four nozzle groups 24 contained in the first nozzle row 21*a*, the first nozzle group 24*a* and the second nozzle group 24*b* that are positioned on one side (for example at the rear) in the nozzle row direction, in which plural nozzles are arrayed, are driven within the range of discharge duty upper limits that are not 0%, and controls driving such that the third nozzle group 24*c* and the fourth nozzle group 24*d* positioned on the other side in the nozzle row direction (for example at the front) are driven with discharge duty upper limits of 0%. The head drive section 16 also controls driving such that, from out of the four nozzle groups 24 contained in the second nozzle row 21*b*, the first nozzle group 24*a* and the second nozzle group 24*b* that are positioned at the one side in the nozzle row direction (for example at the rear) are driven with discharge duty upper limits of 0%, and the third nozzle group 24*c* and the fourth nozzle group 24*d* positioned on the other side in the nozzle row direction (for example at the front) are driven within a range of discharge duty upper limits that are not 0%.

The first nozzle group 24*a* and the second nozzle group 24*b* of the first nozzle row 21*a* are thereby driven within a range of discharge duty upper limits that are not 0% (100%, 50%). The discharge duty upper limit values of the first nozzle group 24*a* and the second nozzle group 24*b* of the second nozzle row 21*b* are 0%, and so no ink is discharged. Similarly, the discharge duty upper limit values of the third nozzle group 24*c* and the fourth nozzle group 24*d* of the first nozzle row 21*a* are 0%, and so ink is not discharged. The third nozzle group 24*c* and the fourth nozzle group 24*d* of the second nozzle row 21*b* are driven within a range of discharge duty upper limits that are not 0% (50%, 100%).

Thus, for pairs of nozzle groups 24 adjacent across the nozzle rows 21, there is a state in which one of the nozzle groups 24 discharges ink, and the other does not discharge ink. This thereby enables generation of air current C from the recording medium M toward the nozzle face 23 to be further suppressed during discharge. Thus, adhesion of ink mist to the nozzle face 23 can be effectively suppressed.

In such cases, in a single recording pass, only one out of the adjacent nozzle rows 21 discharges ink over a given region of the recording medium M. For example, in the region onto which cyan ink is discharged from the first nozzle group 24*a* of the first nozzle row 21*a* in the first recording pass, for the same region in the first recording pass, magenta ink is not discharged from the second nozzle group 24*b* of the second nozzle row 21*b*, and next in the second recording pass, magenta ink is discharged from the third nozzle group 24*c* of the second nozzle row 21*b*. This thereby enables a difference in impact time to be achieved between the different inks, enabling occurrence of bleeding due to color mixing of the inks to be suppressed.

Moreover, in an adjacent pair of nozzle rows 21, for example in the first nozzle row 21*a* and the second nozzle row 21*b*, the second nozzle group 24*b* positioned furthest to the front out of the first nozzle group 24*a* and the second nozzle group 24*b*, which are controlled to drive with discharge duty upper limits of the first nozzle row 21*a* that are not 0%, and the third nozzle group 24*c* positioned furthest to the rear out of the third nozzle group 24*c* and the fourth nozzle group 24*d*, which are controlled to drive with discharge duty upper limits of the second nozzle row 21*b* that are not 0%, have a comparatively close positional relationship to each other despite not having a positional relationship of adjacency across the nozzle rows 21.

Suppose, for example, that the second nozzle group 24*b* of the first nozzle row 21*a* were to be driven within a range of the maximum discharge duty upper limit of the first nozzle group 24*a* and the second nozzle group 24*b* of the first nozzle row 21*a* (for example 100%), and that the third nozzle group 24*c* of the second nozzle row 21*b* is also driven within a range of the maximum discharge duty upper limit of the third nozzle group 24*c* and the fourth nozzle group 24*d* of the second nozzle row 21*b* (for example 100%). In such a case there would be a concern that an air current C from the recording medium M toward the nozzle face 23 might be generated by the liquid being discharged from the second nozzle group 24*b* of the first nozzle row 21*a* and the third nozzle group 24*c* of the second nozzle row 21*b*.

In contrast thereto, in the present modified example, the second nozzle group 24*b* of the first nozzle row 21*a* is driven within the range of the minimum discharge duty upper limit of the first nozzle group 24*a* and the second nozzle group 24*b* of the first nozzle row 21*a* (50%), and the third nozzle group 24*c* of the second nozzle row 21*b* is also driven within the range of the minimum discharge duty upper limit of the third nozzle group 24*c* and the fourth nozzle group 24*d* of the second nozzle row 21*b* (50%). This thereby enables generation of an air current C from the recording medium M toward the nozzle face 23 by the liquid discharged from the second nozzle group 24*b* of the first nozzle row 21*a* and the third nozzle group 24*c* of the second nozzle row 21*b* to be suppressed. This thereby enables adhesion of ink mist to the nozzle face 23 to be more effectively suppressed.

Explanation has been given in the present exemplary embodiment of the recording apparatus 1 that discharges ink onto the recording medium M as an example of the liquid discharging apparatus, however there is no limitation thereto. The liquid discharging apparatus may be an apparatus that discharges various types of liquid, such as, for example, a liquid crystal material, an organic electroluminescent (EL) material, a metal wiring material, or the like, onto various workpieces, such as a glass substrate.

The entire disclosure of Japanese Patent Application No. 2014-89887, filed Apr. 24, 2014 and 2015-2930, filed Jan. 9, 2015 are expressly incorporated by reference herein.

What is claimed is:

1. A liquid discharging apparatus comprising:

a liquid discharge head that includes a plurality of nozzle rows each arrayed with a plurality of nozzles, and that discharges liquid droplets onto a workpiece by a multi-pass method using n recording passes, where n is an integer of 3 or more; and a head drive section that controls driving of n nozzle groups corresponding to the n recording passes in each of the nozzle rows within a range of a discharge duty upper limit specific to each nozzle group, and for a pair of nozzle groups adjacent across the nozzle rows, when controlling driving of one of the nozzle groups within a range of a first discharge duty upper limit that is the maximum discharge duty upper limit of one nozzle row containing the one nozzle group, controls driving of the other nozzle group within a range of a second discharge duty upper limit that is not the maximum discharge duty upper limit of another nozzle row containing the other nozzle group.

2. The liquid discharging apparatus of claim 1, wherein the second discharge duty upper limit is less than the first discharge duty upper limit.

3. The liquid discharging apparatus of claim 2, wherein the second discharge duty upper limit is the minimum discharge duty upper limit in the other nozzle row containing the other nozzle group.

4. The liquid discharging apparatus of claim 1, wherein:

out of the n nozzle groups contained in the one nozzle row, the head drive section controls driving of a plurality of first nozzle groups that are positioned on one side in the nozzle row direction in which the plurality of nozzles are arrayed within a range of respective discharge duty upper limits that are not 0%, and controls driving of a plurality of the nozzle groups that are positioned on the other side in the nozzle row direction with a discharge duty upper limit of 0%, and out of the n nozzle groups contained in the other nozzle row, the head drive section controls driving of a plurality of the nozzle groups that are positioned at the one side in the nozzle row direction with a discharge duty upper limit that is 0%, and controls driving of a plurality of second nozzle groups that are positioned on the other side in the nozzle row direction within a range of respective discharge duty upper limits that are not 0%.

5. The liquid discharging apparatus of claim 4, wherein out of the plurality of first nozzle groups, the head drive section controls driving of the nozzle group that is positioned furthest to the other direction side in the nozzle row direction within a range of a discharge duty upper limit that is the minimum discharge duty upper limit of the plurality of first nozzle groups, and, out of the plurality of second nozzle groups, the head drive section controls driving of the nozzle group that is positioned furthest to the one side in the nozzle row direction within a range of discharge duty upper limit that is the minimum discharge duty upper limit of the plurality of second nozzle groups.

6. A liquid discharge method for a liquid discharging apparatus including a liquid discharge head that includes a plurality of nozzle rows each arrayed with a plurality of nozzles, and that discharges liquid droplets onto a workpiece by a multi-pass method using n recording passes, where n is an integer of 3 or more, the liquid discharge method comprising:

when driving n nozzle groups corresponding to the n recording passes in each of the nozzle rows within a range of a discharge duty upper limit specific to each nozzle group, and for a pair of nozzle groups adjacent across the nozzle rows, when driving one of the nozzle groups within a range of a first discharge duty upper limit that is the maximum discharge duty upper limit of one nozzle row containing the one nozzle group, driving the other nozzle group within a range of a second discharge duty upper limit that is not the maximum discharge duty upper limit of another nozzle row containing the other nozzle group.

* * * * *